US007178695B1

(12) United States Patent
Malenfant et al.

(10) Patent No.: US 7,178,695 B1
(45) Date of Patent: Feb. 20, 2007

(54) DISPENSER FOR A LIQUID OR SEMI-SOLID MATERIAL

(75) Inventors: Jean-Claude Malenfant, St-Jean-de-Dieu (CA); Eric Malenfant, St-Jean-de-Dieu (CA); Yves Malenfant, St-Jean-de-Dieu (CA)

(73) Assignee: Jean-Claude Malenfant et al., St. Jean-de-Dieu (CA)

( * ) Notice: Subject to any disclaimer, the term of this patent is extended or adjusted under 35 U.S.C. 154(b) by 0 days.

(21) Appl. No.: 11/237,738

(22) Filed: Sep. 29, 2005

(51) Int. Cl.
*B67D 5/64* (2006.01)

(52) U.S. Cl. ..... 222/166; 222/608; 414/490

(58) Field of Classification Search ..... 222/166, 222/608, 185.1; 280/79.5; 414/444, 453, 414/457, 490
See application file for complete search history.

(56) References Cited

U.S. PATENT DOCUMENTS 2,477,294 A * 7/1949 Fuller ..... 414/448
3,198,395 A * 8/1965 McKinney ..... 222/166
5,582,503 A * 12/1996 Sandoval ..... 414/738
5,638,991 A * 6/1997 Todden et al. ..... 222/608
2002/0113098 A1* 8/2002 Camacho et al. ..... 222/608

* cited by examiner

*Primary Examiner*—Philippe Derakshani
(74) *Attorney, Agent, or Firm*—Goudreau Gage Dubuc

(57) ABSTRACT

A dispenser for depositing at least one of lines and stripes of at least one material, comprising a trolley having front and back wheels and securing at least one container on a platform thereof, the trolley being movable between an in-use position, wherein the trolley is straighten up on the front wheels thereof allowing a content of the at least one container to be out from at least one aperture on a bottom part of the at least one container, and an out-of use position, wherein the trolley rests on rear wheels thereof and the content of the at least one container is stopped from flowing out from the at least one aperture.

6 Claims, 4 Drawing Sheets

DISPENSER FOR A LIQUID OR SEMI-SOLID MATERIAL

FIELD OF THE INVENTION

The present invention relates to dispensers. More specifically, the present invention is concerned with a liquid or semi-solid material dispenser.

SUMMARY OF THE INVENTION

In accordance with the present invention, there is provided a dispenser for a material, comprising a trolley with securing means and handles; and at least one container secured on the trolley by the securing means; the trolley being movable between an out-of use position on front wheels thereof, and an in-use position on rear wheels thereof, wherein the trolley is tilted up to allow a content of the at least one container to flow out from at least one aperture on a bottom part of the at least one container.

There is further provided a dispenser for depositing at least one of lines and stripes of at least one material, comprising a trolley securing at least one container, the trolley being tiltable between an in-use position wherein the trolley is straighten up thereby allowing a content of the at least one container to flow out from at least one aperture on a bottom part of the at least one container, and an out-of use position wherein the content of the at least one container is stopped from flowing out from said at least one aperture.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

Figure 1:
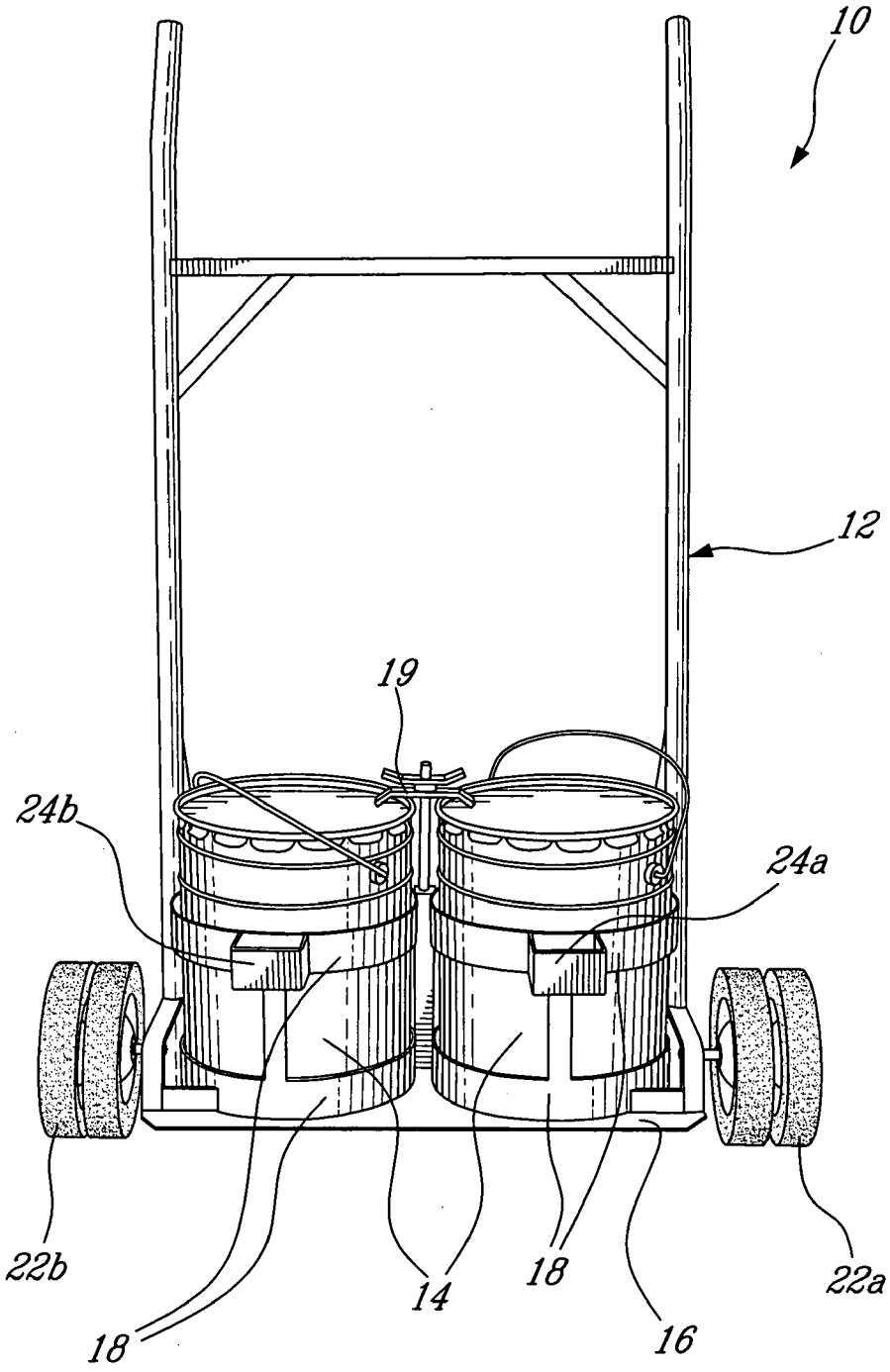
FIG. 1 is a perspective front view of a dispenser according to an embodiment of the present invention.
Figure 2:
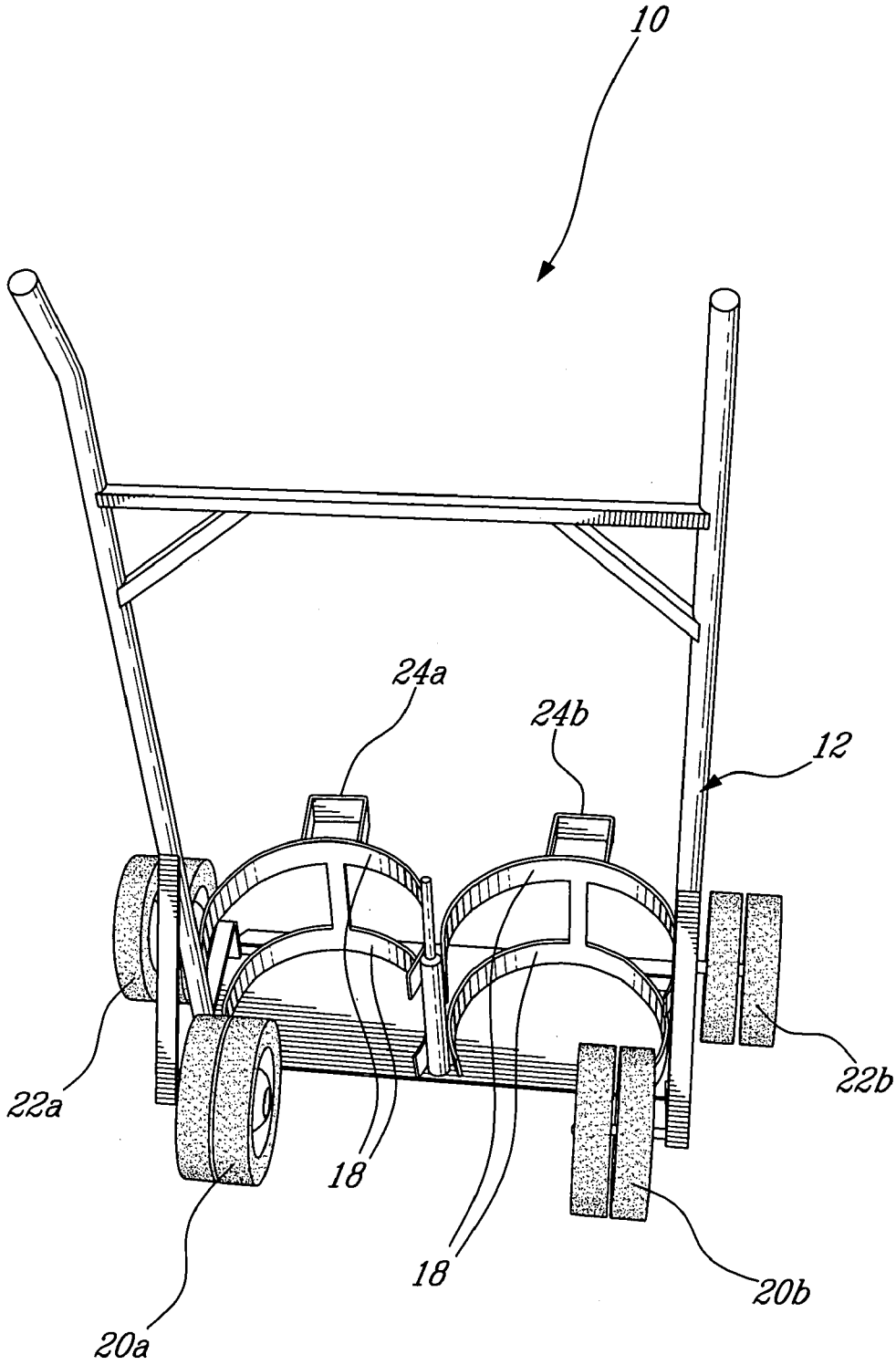
FIG. 2 is a perspective view of the dispenser of FIG. 1, without containers, as seen from a position of a user thereof.

The present invention is illustrated in further details by the following non-limiting examples.

As illustrated in FIGS. 1 to 4 of the appended drawings, a dispenser 10 according to an embodiment of the present invention comprises a trolley 12 supporting at least one container 14.

The trolley 12 typically comprises an upper section with handles 15 to allow a use to drive it. In a lower section thereof, the trolley 12 comprises a supporting platform 16 fitted with securing means to receive the at least one container 14.

The trolley comprises for example a first pair of wheels 20*a*, 20*b* at the front thereof, towards the user, and a second pair of wheels 22*a* 22*b* at the rear thereof.

In the example illustrated in the Figures, the dispenser 10 comprises two containers. The containers 14 are secured by guards, which may have a semi circular shape in the case of cylindrical containers 14 as illustrated herein, on the supporting platform 16. Retaining means 19, best seen in FIGS. 1 and 4, further secure the containers 14.

Each container 14 may be secured on the platform 16 individually by its own securing means, or a common securing means may be contemplated to secure all containers 14 on the platform 16.

Figure 3:
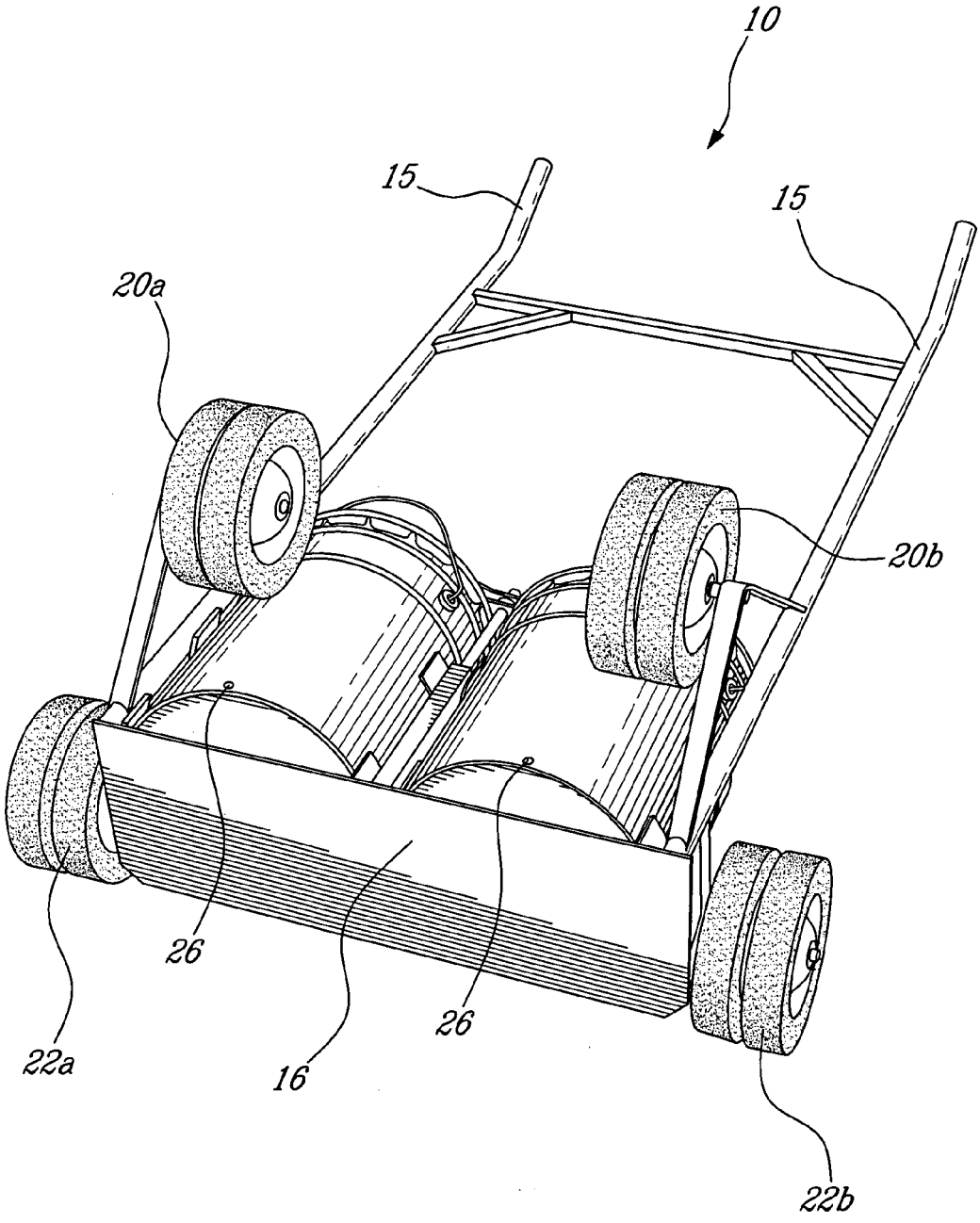
FIG. 3 is a perspective view of the dispenser of FIG. 1 in a out-of-use position.
Figure 4:
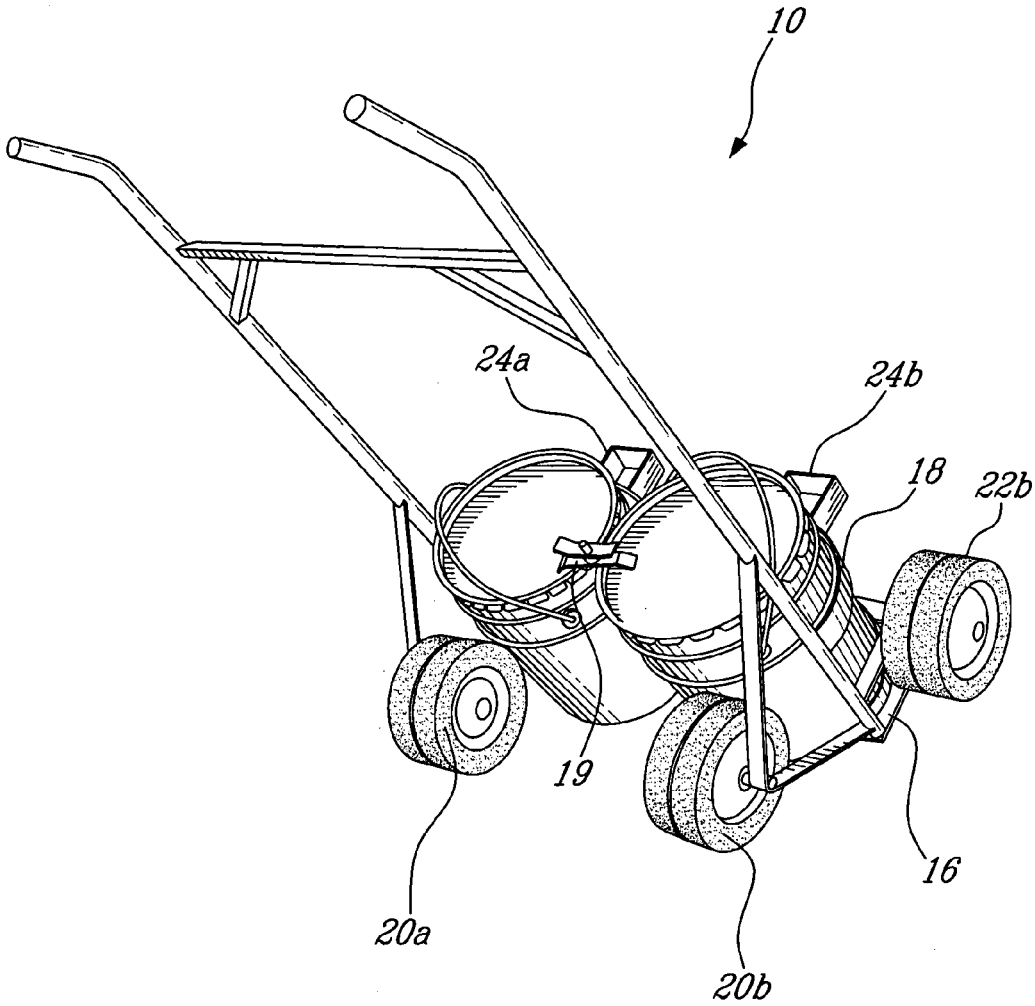
FIG. 4 is a perspective view of the dispenser of FIG. 1 in an in-use position.

In FIG. 3, the trolley 12 is in an out-of use position, i.e., resting on the rear wheels 22*a*, 22*b* and on projections 24*a*, 24*b* of the guards 18, best seen in FIG. 4. The lower part of the lateral wall of the containers 14 is provided with apertures 26 allowing a material contained in the containers 14 to flow therefrom, a distance between apertures and a shape thereof in each containers, in the cases of at least two containers, being predetermined in relation to a distance between lines or stripes of material to produce and a shape thereof.

The projections 24*a*, 24*b* of the guards 18 may be rings or spikes allowing maintaining the trolley 12 in the out-of use position of FIG. 3, i.e., resting on the rear wheels 22*a*, 22*b* without the content of the containers 14 being spilled therefrom.

FIG. 4 shows the trolley 12 being in an in-use position, wherein the trolley 12 is ready to be driven by a user (not shown); the user tilts the trolley from the position illustrated in FIG. 3 to the position of FIG. 4 where it is straighten up on its front wheels 20*a*, 20*b*, and then pulls the trolley by an action on the handles 15, over a selected distance on which the material of the containers is to be spread. Once it is done, the user stops the content of the containers from flowing out by tilting the trolley 12 back on its rear wheels 22*a*, 22*b* towards the position of FIG. 3.

Therefore, the dispenser of the present invention allows depositing on a surface at least one line or stripe of glue for example, over a target length, or two lines or stripes of glue separated by a target distance over a given length for example, precisely and without wasting material.

The dispenser may be adapted to adjust a number of containers of varied shapes.

The present examples describe using the dispenser for depositing glue beads, but it may be used to precisely and cleanly deposit a variety of material, such as liquids and semi-solid materials, including adhesives, coatings, paint, sand and gravel for example, along lines or stripes of a variety of shapes and geometry depending on the shape of the apertures provided on the wall surface of the containers. Moreover, each container may be used to simultaneously deposit more than one line of material, depending on the number of apertures provided on the wall surface thereof.

Although the present invention has been described hereinabove by way of specific embodiments thereof, it can be modified, without departing from the spirit and nature of the subject invention as defined in the appended claims.

What is claimed is:

1. A dispenser for a material, comprising:

a trolley with securing means and handles; and at least one container secured on said trolley by said securing means;

the trolley being movable between an out-of use position on front wheels thereof, and an in-use position on rear wheels thereof, wherein the trolley, in said in-use position, is tilted up to allow a content of the at least one container to flow out from at least one aperture on a wall of the at least one container, the content of the at least one container being deposited on a surface along ones of dots and lines as the trolley is moved on the surface by a user.

2. The dispenser of claim 1, comprising two containers, a distance between the at least one aperture of each container and a shape of the at least one aperture of each container being predetermined in relation to a distance between lines of material to deposit on the surface and a shape of the lines of material to deposit on the surface.

3. The dispenser of claim 1, comprising one container, said container having a number and shape of apertures corresponding to a number and shape of the lines of material to deposit on the surface.

4. The dispenser of claim 1, said dispenser being pulled, in the in-use position, by a user over a selected distance on which the content of the at least one container is to be spread, the content being stopped from flowing out of the at least one container by tilting the trolley towards the out-of-use position.

5. The dispenser of claim 1, wherein the material is selected from the group consisting of liquids and semi-solids.

6. A dispenser for depositing at least one of lines and stripes of at least one material on a surface, comprising a trolley securing at least one container, the trolley being tiltable between an out-of use position in which a content of the at least one container is prevented from flowing out from at least one aperture on a bottom part of the at least one container and an in-use position in which the trolley is straighten up from the out-of-use position towards a user thereby allowing the content of the at least one container to flow out from the at least one aperture, the content of the at least one container being deposited on the surface along at least one of lines and stripes as the trolley is moved on the surface by the user.

* * * * *